US005818477A

United States Patent [19]

Fullmer et al.

[11] Patent Number: 5,818,477

[45] **Date of Patent: *Oct. 6, 1998**

[54] IMAGE FORMING SYSTEM AND PROCESS USING MORE THAN FOUR COLOR PROCESSING

[76] Inventors: Timothy S. Fullmer, 1933 E. Ashley Ridge Rd., Sandy, Utah 84092; Arthur D. Thomas, 1808 E. Ann Dell Ln., Salt Lake City, Utah 84121

[ * ] Notice: The term of this patent shall not extend beyond the expiration date of Pat. No. 5,623,288.

[21] Appl. No.: 627,729

[22] Filed: Apr. 2, 1996

Related U.S. Application Data

[63] Continuation-in-part of Ser. No. 236,527, Apr. 29, 1994, Pat. No. 5,623,288.

[51] Int. Cl.[6] ..... B41J 2/045

[52] U.S. Cl. ..... 347/43

[58] Field of Search ..... 347/3, 6, 8, 12, 347/14, 16, 21, 24, 37, 40, 43, 83, 104

[56] References Cited

U.S. PATENT DOCUMENTS

| | | | |
|---|---|---|---|
| 4,146,900 | 3/1979 | Arnold | 346/75 |
| 4,789,871 | 12/1988 | Uddgren | 347/44 |
| 4,839,666 | 6/1989 | Jayne | 346/75 |
| 4,914,522 | 4/1990 | Duffield et al. | 358/296 |
| 4,999,651 | 3/1991 | Duffield et al. | 347/3 |
| 5,144,328 | 9/1992 | Blake et al. | 346/1.1 |
| 5,294,946 | 3/1994 | Gandy et al. | 346/140 |
| 5,376,957 | 12/1994 | Gandy et al. | 347/3 |
| 5,530,465 | 6/1996 | Hasegawa | 347/70 |
| 5,623,288 | 4/1997 | Thomas et al. | 347/3 |

*Primary Examiner*—Matthew V. Nguyen
*Attorney, Agent, or Firm*—L. E. Carnahan

[57] ABSTRACT

An image forming system capable of using more than four colors for making enlarged prints, such as billboards, which utilizes a recording medium mounted on a rotating cylinder and which is supported so as to prevent deflection, utilizing a plurality of computer controlled spray heads having flow adjusting means which traverse the width of the recording medium and spray a deposition medium onto the recording medium in accordance with scanning signals from an original image to reproduce the image on the recording medium. Each of the spray heads being provided with means for applying colors or coatings in addition to the standard four color processing. The invention also includes apparatus and processes for mirror image forming on opposite sides of the recording medium and/or forming images on the recording medium using a translucent recording medium.

31 Claims, 10 Drawing Sheets

IMAGE FORMING SYSTEM AND PROCESS USING MORE THAN FOUR COLOR PROCESSING

RELATED APPLICATION

This is a continuation-in-part of U.S. application Ser. No. 08/236,527, filed Apr. 29, 1994 U.S. Pat. No. 5,623,288, entitled "Improved Image Forming System and Process", and assigned to the same assignee.

BACKGROUND OF THE INVENTION

The present invention relates to a system for reproducing color images by scanning an original and using computer directed signals to control an ink-spray head, particularly to an improved image forming system and process using a drive roller assembly and deflection prevention means, a plurality of adjustable spray heads, and/or apparatus for forming images on opposite sides of a recording medium, and more particularly to such a system having the capability to apply more than the standard four colors during normal processing.

Over the years various systems and processes have been utilized for reproducing color images. Substantial effort has been directed to systems for making enlarged prints, such as for billboards. In such prior systems an original image is scanned to produce control signals that operate the reproduction equipment. The image to be reproduced is placed on a conventional scanner and the image is scanned in a conventional manner, with the signals from the scanner being modified by a computer to achieve the desired effects (e.g. color) with the particular deposition medium (e.g. ink) being used. These signals control the movement and operation of the spray head and the speed of movement of a substrate or recording medium on which the image is to be formed.

U.S. Pat. No. 4,914,522 issued Apr. 3, 1990 to P. L. Duffield et al exemplifies the prior imaging systems and discusses early efforts for reproducing enlarged prints or images, such as used for outdoor advertising, artistic representations, and other purposes, which are produced on sheets of recording medium, such as paper or vinyl, while being transported from a supply-roll to a take-up roll. Thus, very long and/or wide images can be produced. This patent employs the use of separate ink and air supply jets whereby a flow of air, supplied at a constant pressure, is turned on and off in accordance with the control signals and passes across an ink meniscus formed on the tip of an ink jet or nozzle, causing the ink to be sprayed onto the recording medium.

U.S. Pat. No. 4,839,666 issued Jun. 13, 1989 to W. Jayne involves an image forming system in which controlled amounts of a deposition medium, such as ink, are sprayed from an orifice for deposition on a surface. This is accomplished by using a pneumatically driven image forming system capable of supplying a precisely controlled volume of the deposition medium through a spray head, having coaxial air and deposition medium nozzles, which forms a siphon feed means drawing a controlled amount of the deposition medium from within the spray head through an orifice in the spray head.

U.S. Pat. No. 5,144,328 issued Sep. 1, 1992 to D. Blake et al is directed to a method for producing a large scale color graphic that presents substantially the same spectral content to a viewer when the graphic is illuminated with front or back lighting. This is accomplished by applying a color film on a first surface and a second color film on a second surface such that the color films create the desired colored graphic image and are produced in registry with one another. The color films may be formed on opposite sides of a sheet-like substrate so as to define mirror images of each other, or the first color film formed on one surface of the substrate and the second color film formed on one surface of a translucent substrate which is positioned over the first color film such that the translucent substrate is between the color films and the color films are in registry to produce a resultant desired color forming image.

While the prior art imaging systems and processes have provided the capability to produce enlarged colored images in various sizes and colors, the imaging process is slow and thus costly. For example, with prior known imaging systems, each pass of the printer assembly across the recording medium or substrate produces a very narrow band (about 0.1–0.2 inch) of the image, thus requiring numerous passes of the printer assembly. Thus, there is a need in this art for a system and/or process by which the imaging speed can be increased, and cleaning of the spray nozzles can be done automatically. Also, there is a need in the art, particularly for large imaging systems, of a means to prevent/reduce/eliminate deflection of the recording medium due to its width, whereby the image can be formed thereon without the need of compensation. In addition, there is a need for a more economical way of producing large scale colored images that involve illumination with both front and back lighting. Also, there is a need in the art to enable the use of more than the standard four color processes to produce the varied color, hues, tones, etc. required to formulate a desired image and allow special colors or coatings to be applied while being produced on the machine during normal processing of the image.

The above-mentioned needs in the large scale imaging systems are satisfied by the apparatus and process of the present invention. The speed of imaging is increased by using a plurality of adjustably controlled spray heads by which a larger strip of the image is deposited on the recording medium at each pass across the medium, thus reducing the number of passes. By the use of automatic cleaning of the spray heads, down time is decreased. The deflection problem is solved by an improved roller type support mechanism for the recording medium, and which allows the recording medium to be easily replaced without substantial down time of the imaging system. The imaging for front and back lighting is accomplished by a modification of the existing systems and processes to enable the formation of mirror images on opposite sides of the recording medium and/or the use of special translucent and/or transparent coatings. The greater than four color processing is accomplished by the use of additional ink ports modulated and controlled to apply special colors or coatings during or after the normal pass through of the spray heads to form the image. Thus, the present invention enables the production of large color images of various colors, while reducing the time and associated costs involved in the imaging operation.

SUMMARY OF THE INVENTION

It is an object of the invention to provide an improved imaging system, which can apply colors and/or coatings in addition to the standard four color processing.

A further object of the invention is to provide an adjustable spray-head for imaging systems, and which can be cleaned automatically.

A further object of the invention is to provide a large scale color imaging system which utilizes a plurality of adjustably controlled spray heads, and has the capability to apply greater than the standard four colors.

Another object of the invention is to provide a recording medium support apparatus involving support rollers which eliminates deflection of the recording medium and allows for easy replacement of the recording medium.

Another object of the invention is to provide an apparatus and process for producing large scale color graphics which can be illuminated by front lighting and back lighting, and can apply colors greater than the standard four colors.

Other objects and advantages of the present invention will become apparent from the following description and accompanying drawings. The invention involves an improved imaging system and process, particularly for large scale color imaging, such as billboards, etc., and enables the application of additional colors (five or more) and/or coatings during processing. The imaging system utilizes a support mechanism which eliminates deflection problems associated with wide sheets of recording medium, thus removing the need for spray head compensation. The improved imaging system utilizes a plurality of adjustably controlled spray heads with each spray head containing several spray nozzles, whereby a greater portion of the image is produced on each pass across the recording medium, thereby reducing the image production time. The spray nozzles can be quickly cleaned to enable a change of ink color. By modifications of existing imaging systems, the deposition medium (ink, paint, dye, abrasive, etc.) can be deposited as a single or a mirror image on one or opposite sides of the recording medium, or on the same side with a translucent paint between identical images, and/or the use of translucent and transparent substrates, for applications using back lighting and/or front lighting. By use of additional modulated and controlled ink ports, special logo colors, graffiti coatings, and special effect paints can be applied during normal pass through processing of the image. While the present invention is particularly applicable for large scale color imaging, the apparatus and/or process thereof may be utilized in other imaging or reproduction applications.

BRIEF DESCRIPTION OF THE DRAWINGS

The accompanying drawings, which are incorporated into and form a part of the disclosure, illustrate embodiments of the invention and, together with the description, serve to explain the principles of the invention.

DETAILED DESCRIPTION OF THE INVENTION

The present invention is directed to applying five or more colors in an imaging apparatus. More specifically, the present invention is directed to an imaging apparatus and process for producing large color, as well as black and white, reproductions or images, and involves the use of plural spray heads which can apply greater than the standard four colors (yellow, magenta, cyan, black), and recording medium supply, support, and movement apparatus, by which imaging time and associated costs are reduced. The present invention utilizes apparatus generally similar to that of above-referenced U.S. Pat. No. 4,914,522 and U.S. Pat. No. 4,839,666, but modified to eliminate problems in the prior art imaging apparatus and spray heads. However, the invention, capable of using five or more colors, may be utilized in other imaging apparatus and spray heads, including digigraphic technology, flow through pulsed air brush technology, ink jet technology, or other technology for producing small or large format reproductions for advertising or other uses. The improved spray head of the present invention uses coaxial air and deposition medium flow arrangement, but includes a means for establishing and maintaining concentricity of the components forming the coaxial spray nozzle, as well as an adjustable control mechanism for supply of the ink and/or air, or both. Also, the present invention utilizes a plurality of spray heads whereby the number of passes across the recording medium is reduced, and each spray head may include several coaxial spray nozzles thereby greatly reducing the image production time. In addition, the spray nozzles can be automatically cleaned. The present invention utilizes a plural color process for generating the images, and an example of such a process is described in above-referenced U.S. Pat. No. 5,144,328, but in addition has the capability to apply additional colors and/or coatings during normal processing.

The term "ink" as used hereinafter defines a deposition medium which may be composed of an ink, paint, dye or other medium which can be deposited on or which abrades the recording medium via one or more spray heads. The term deposition medium (ink) as used and described hereinafter is not limited to any specific composition and, for example, may be of a solvent-base or a water-base type, and may be of any color or color combination required to produce the desired end product.

Figure 1:
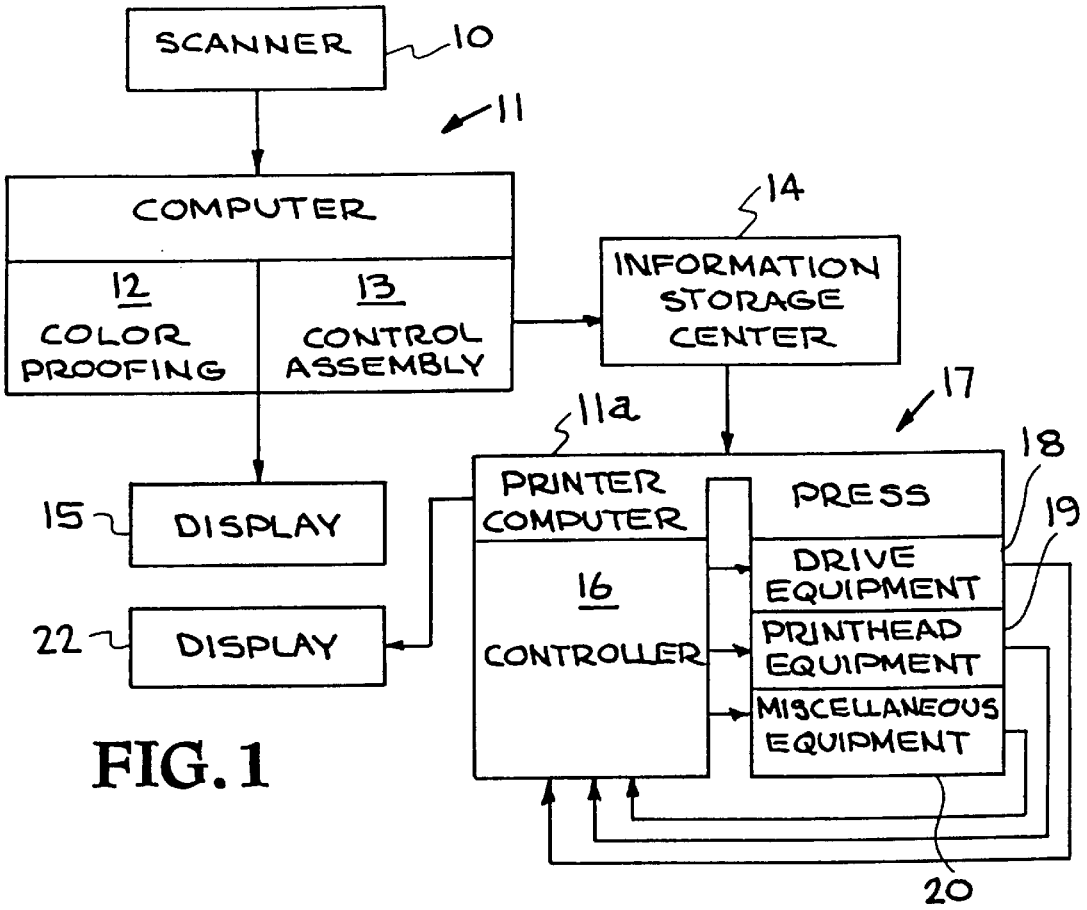
FIG. 1 is a block diagram illustrating the major components which carry out the sequence of operations of the imaging system of the present invention.

Referring now to the drawings, FIG. 1 illustrates in block diagram the major components and operational sequence of the computer controlled imaging system of the present invention. The system generally includes a scanner 10 onto which is placed an image to be reproduced and the image is scanned in conventional manner. In operation, scanner 10 inspects the image to be reproduced horizontally pixel-by-pixel and vertically line-by-line. For each pixel, a composite signal is generated carrying the color information. However, in some situations the scanner 10 is not needed, such as when using a previously developed tape, or using computer generated art. The output signals from the scanner 10 are directed into a computer 11 where they are adjusted/modified using the computer section 12 to achieve the desired color effects and intensities with the particular inks being used. These signals are fed into a control assembly section 13 of computer 11 which allows other data to be blended with it completing the desired image. The scanned image, color modification, etc. is also displayed on a computer display 15 enabling/assisting the operator to make any desired adjustments. When color, data, etc. is complete, those control signals are fed into an information storage center 14. The information storage center 14 may be a taping mechanism, a digital storage medium, a disc, etc. whereby the information obtained from computer section 13 may be used immediately or stored for later use and/or both. Signals from the information storage center 14 are fed into printer computer 11*a* of a printer press mechanism, generally indicated at 17, which includes a controller 16, drive equipment 18, printhead equipment 19, and miscellaneous equipment 20 which cooperate as indicated by the arrows to control, modulate and sequence the varied movements of the press mechanism components, and a printer assembly 21 (see FIG. 2), which includes at least one printer or spray head, such as described in greater detail hereinafter. Signals from printer computer 11*a* are fed into a display 22, whereby a color proof thereon is compared with a printed sample, so that the operator can compare and adjust, if any color adjustments are required for various substrates.

Figure 2:
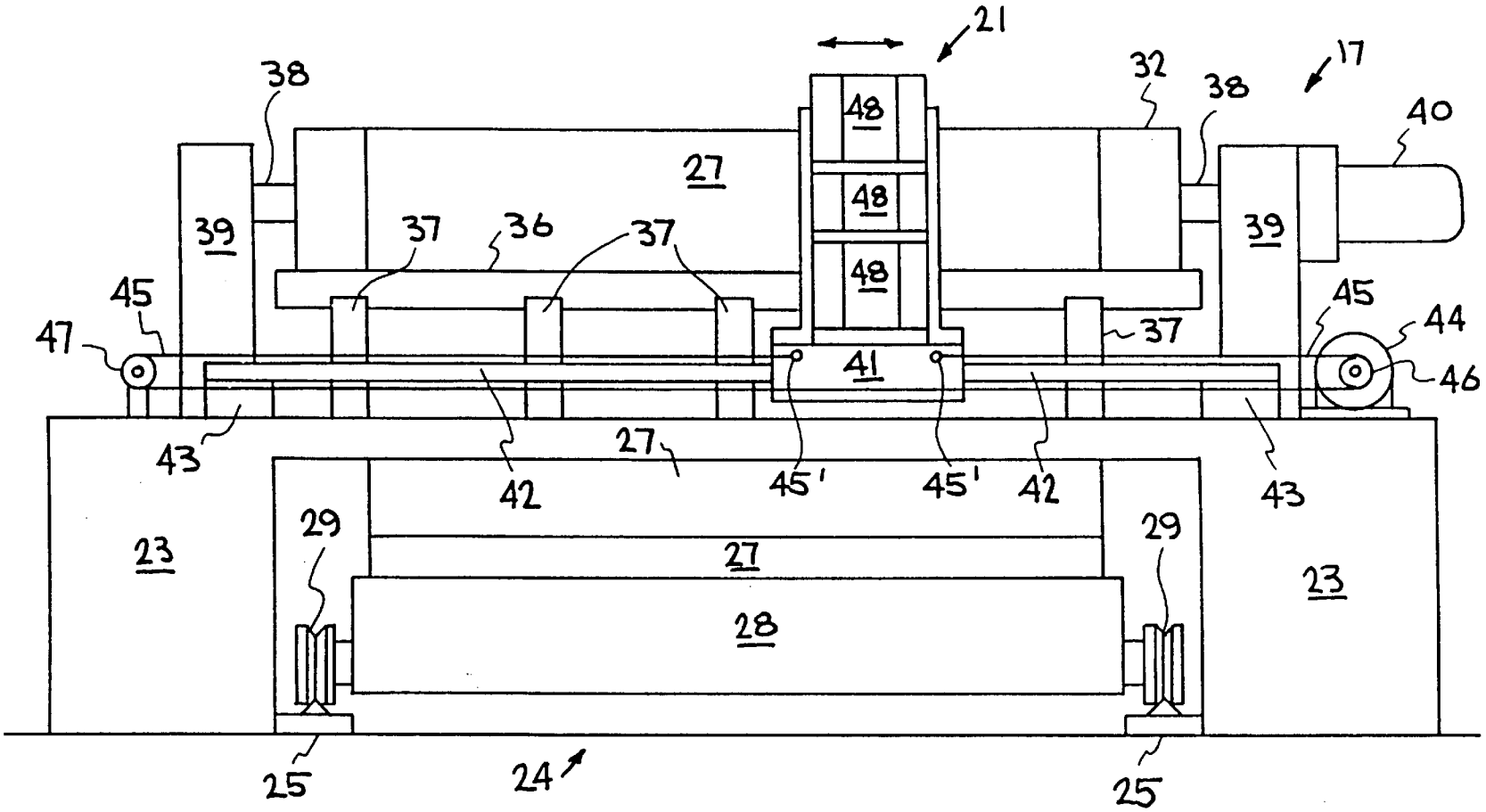
FIG. 2 is a front view of an imaging apparatus made in accordance with the present invention.
Figure 3:
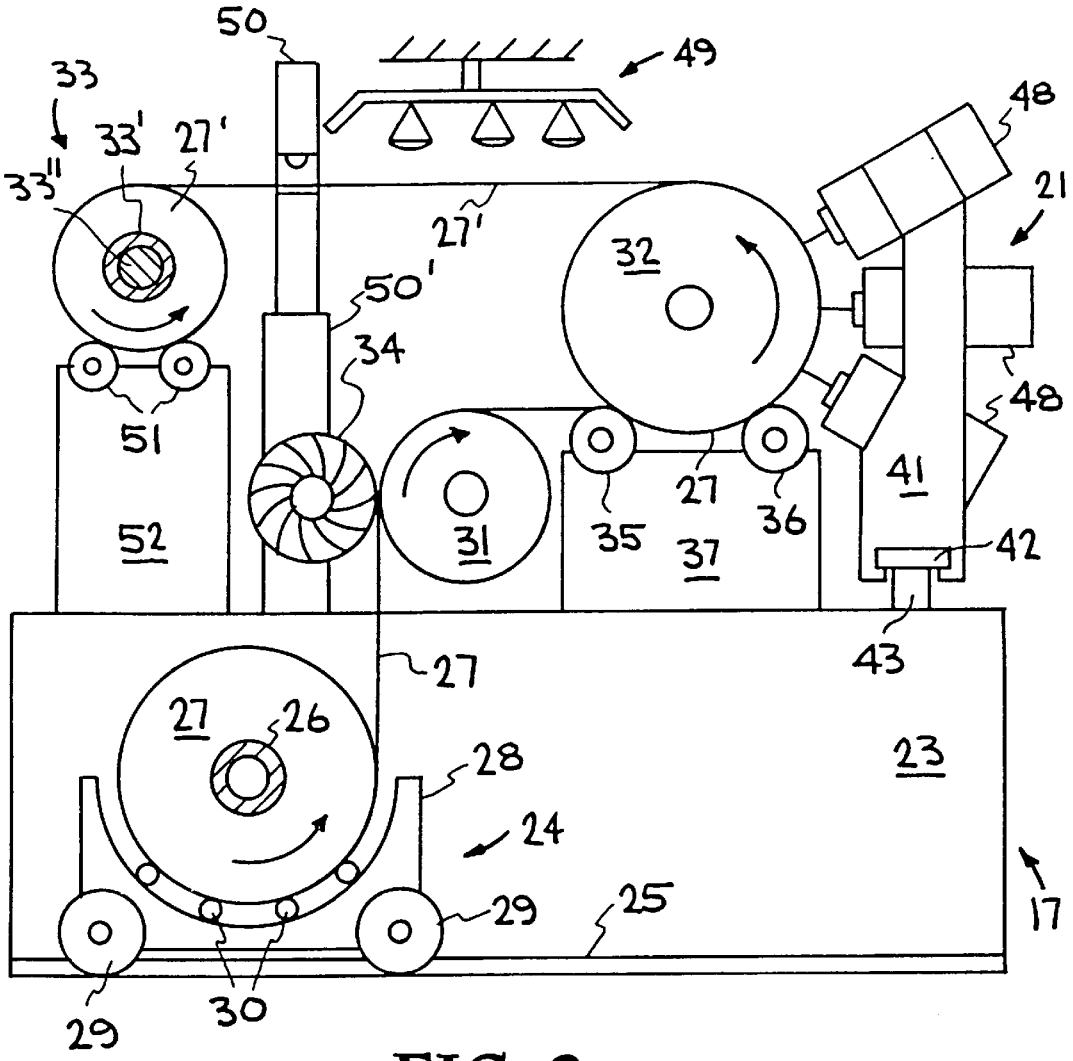
FIG. 3 is a schematic side view of the apparatus of FIG. 2.

FIGS. 2 and 3 illustrate an embodiment of the printer press mechanism 17 on which is movable mounted printer assembly 21 that is controlled by the controller 16 via equipment 18, 19, and 20. The mechanism 17 includes a frame 23 having a recording medium carriage assembly generally indicated at 24 positioned therein and adapted to be moved along tracks 25, whereby a thin hollow member, or tube 26 having recording medium or substrate 27 retained thereon, is positioned in carriage assembly 24 which can be readily removably positioned in mechanism 17. The thin-walled tube 26 may be disposable or reusable, and may be made from cardboard, plastic, etc. Also, the tube 26 may be omitted with the recording medium merely being in the form of a roll. The carriage assembly 24 includes a U-shaped structure (body or housing) 28 supported by a plurality of wheels 29 which cooperate with tracks 25, and located within structure 28 are a plurality of rollers 30 on which the roll of recording or imaging medium 27 is supported. The recording medium 27 is supported on rollers 30 in carriage assembly 24 such that the recording or imaging medium 27 can be easily rotated and the recording medium removable from the U-shaped structure 28. For example, the recording medium may constitute a single roll having a width equal to the capacity of the machine, or other widths or combinations thereof depending on the size, type, or material of the medium desired for the image to be recorded thereon. The recording or imaging medium 27 may be paper, vinyl, or other sheet material compatible with the type of ink being deposited thereon. The tracks 25 may be omitted and wheels 29 may be replaced with other types providing use of different docking mechanism whereby the carriage assembly can be easily and quickly positioned in a desired location in or attached to frame 23 of mechanism 17.

While not shown, the carriage assembly 24 may include a docking mechanism which cooperates with frame 23 to provide quick attachment and release of the carriage assembly 24 to the frame 23 and constructed to provide parallelism between the recording medium 27 and roller assemblies of mechanism 17.

The recording or imaging medium 27 passes over an idler roller 31 (see FIG. 3) and around a platen drive roller assembly 32 and onto a take-up roller assembly 33. Adjacent to idler roller 31 is a rotating brush 34 which functions to smooth the medium 27 as it passes around idler roller 31 onto drive roller assembly 32. Adjacent to and contiguous with platen drive roller assembly 32 are a pair of support roller assemblies 35 and 36 mounted on a plurality of supports 37, which are secured to frame 23. Support rollers 35 and 36 extend the full length of the drive roller 32, and function to retain the medium 27 against the drive roller, eliminating differential movement between medium 27 and roller 32, and for preventing deflection of the platen drive roller 32 along its length. Driver roller assembly 32 includes a shaft section 38 at each end via which it is rotatably mounted at each end by support assemblies 39 secured to frame 23 and driven by an electric motor 40 mounted to one of the support assemblies. Support roller assemblies 35 and 36 may be composed of interconnected sections and the supports 37 may be adjustable to assure that the support rollers 35 and 36 are maintained straight whereby any deflection in the drive roller assembly 32 along its length is minimized, thereby maintaining parallelism between the drive roller assembly 32 and the printer assembly 21.

Printer assembly 21, as shown in FIGS. 2 and 3, includes a carriage 41 movably mounted on a rail 42 secured to frame 23 by members 43 and driven back and forth across the medium 27 by an electric motor 44 secured to one end of frame 23 via a reversing drive cable 45 secured at each end, indicated at 45', to carriage 41 and which extends around a pulley or wheel 46 on motor 44 and around an adjustable idler pulley or wheel 47 secured to an opposite end of frame 23. As seen in FIG. 2, the cable 45 is wound and located to operate vertically. The drive cable arrangement for carriage 41, composed of components 44–47, may be modified to use a non-slip belt in place of cable 45, or the entire drive arrangement may be replaced with a timing belt type drive having a motor and pulleys mounted on the carriage 41 with the ends of the belt secured at each end of frame 23. Also, the drive cable arrangement may be replaced by a rack and pinion type drive arrangement, or other system that will provide accurate and precise locations with smooth operation. The carriage 41, in the FIGS. 2–3 embodiment, supports several printer or spray head assemblies 48 (three shown) which direct ink onto medium 27 as they pass along the width (length) thereof. Details and operation of the multiple spray heads 48 are set forth hereinafter with respect to FIGS. 6–9. While each of the spray heads 48 show only one coaxial spray nozzle, each spray head may contain several nozzles and need not be vertically positioned as shown in FIG. 3. Electric motors 40 and 44 are connected to drive equipment 18 and printhead equipment 19 and are controlled by controller 18 of press mechanism 17, as shown in FIG. 1. As medium 27 is rotated by drive roller 32, ink is deposited thereon from spray heads 48 thereby forming an image on one side of the medium as indicated at 27', which is dried by light assembly 49, or other drying means, such as controlled air flow, and passed over a cutter assembly 50 secured to frame 23 and around take-up roller assembly generally indicated at 33, which may be driven by a motor, not shown, controlled via controller 16, and which includes a thin-walled tube or hollow member 33' supported on a pair of rollers 51 via a support mechanism 52 secured to frame 23. However, a preferred drive arrangement for take-up roller assembly 33 involves driving the rollers 51 via a clutch mechanism and a controlled speed motor, not shown, via controller 16, whereby the take-up tube 33' onto which recording medium 27' is rolled would be rotated at a desired speed and maintain tension on medium 27' by rollers 51. A rod or member 33", which may be solid or hollow, extends through tube 33' and if desired may be used to support means to assure sufficient friction between the medium 27' and rollers 51 to provide the desired tension on medium 27'. The recording medium 27' could be removed by simply lifting it from the rollers 51 and positioning a new tube 33' on the rollers 51 onto which new medium 27' can be rolled. When the image on medium 27' is complete, assembly 50 is activated to cut the medium or substrate, whereby the tube 33' of take-up roller assembly 33 can be removed with the desired image deposited medium 27' rolled thereon, and replaced with another take-up roller for receipt of printed medium passing around drive roller 32. The cutter assembly 50 includes an adjustable (telescoping) support section 50' which allows the cutter to be located against the recording medium 27' when activation thereof is needed.

The take-up roller assembly 33 may be modified from that shown in FIG. 3 by moving the assembly 33 and rollers 51 toward the frame 23 of mechanism 17 and placing a pair of rollers at the current location of tube 33' such that the medium 27' passes between the added pair of rollers which are positioned to provide the desired tension on medium 27', and then onto the take-up tube 33', with the cutter assembly 50 located between the added pair of rollers and the take-up assembly 33. Thus, when the imaging on the medium 27' has passed between the added pair of rollers and cut by assembly 50 the desired tension on the medium passing around drive roller assembly 32 is maintained. Also, a pair of drive rollers, similar to rollers 51, may be substituted for one of the tension rollers described above to assure friction on the roller and maintain the desired tension on the recording medium 27'.

While the FIG. 3 embodiment shows the spray heads 48 positioned to direct ink onto the recording medium 27 as it passes around drive roller assembly 32, the apparatus of FIG. 3 can be modified to produce flat surface printing by adding an idler roller radially from roller 32 whereby the recording medium 27 between the roller assembly 32 and the added idler roller provides a flat surface. The carriage assembly 41 would position the spray heads 48 normal to the flat surface between roller 32 and the added idler roller.

Figure 7:
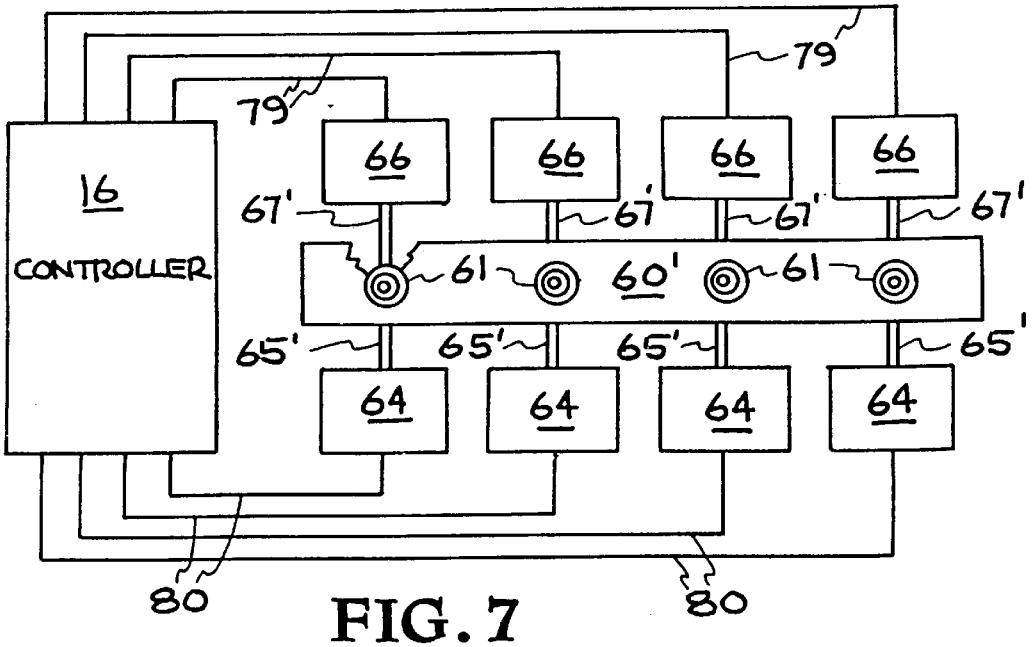
FIG. 7 is a front view of a spray head with a plurality of coaxial nozzles composed of concentric air jets and ink tubes forming the coaxial nozzles, and ink/air supplies therefore, each similar to the embodiment of FIG. 6.
Figure 4:
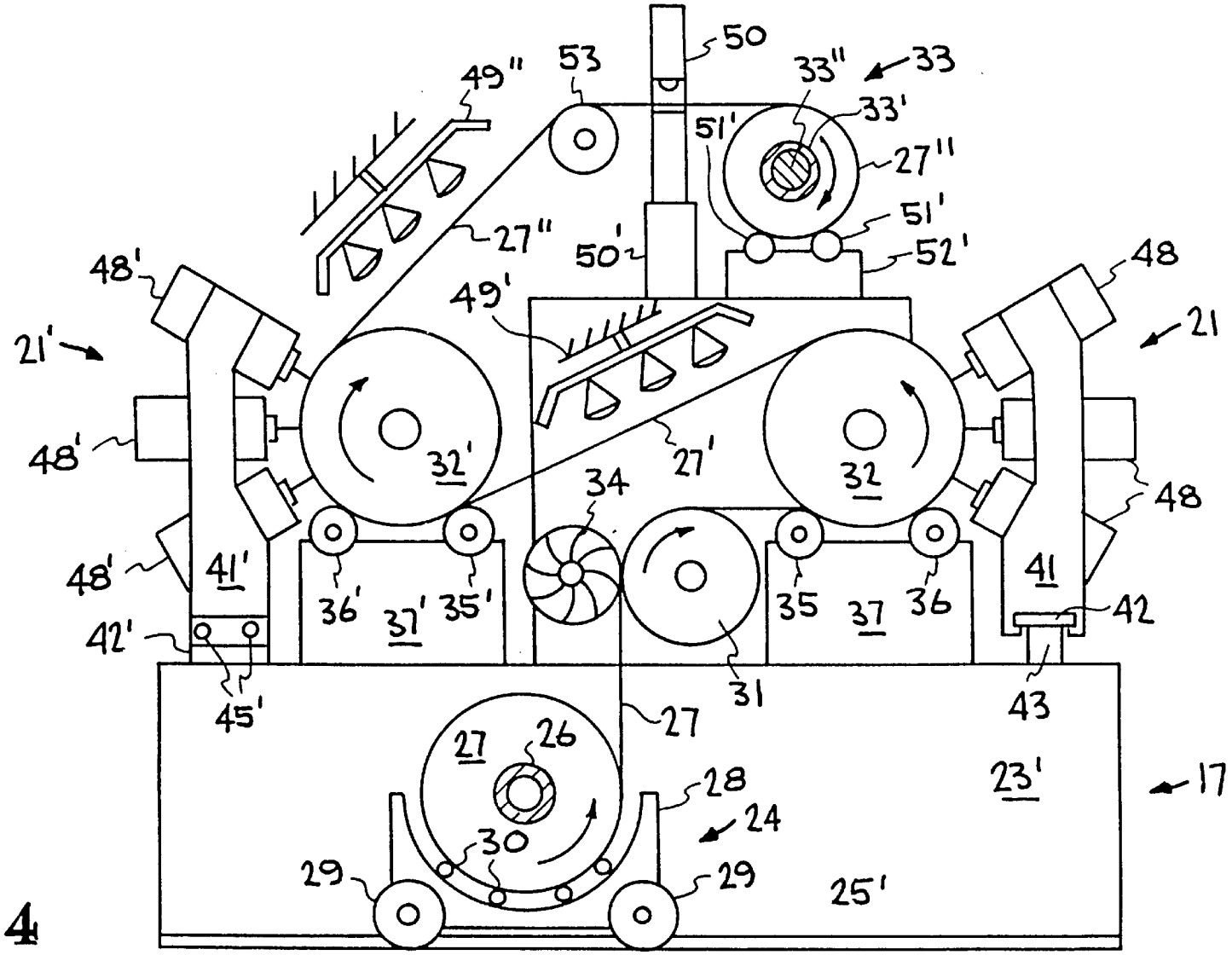
FIG. 4 is a schematic side view of an apparatus similar to FIG. 3 but modified to provide imaging on opposite sides of the recording medium.
Figure 10:
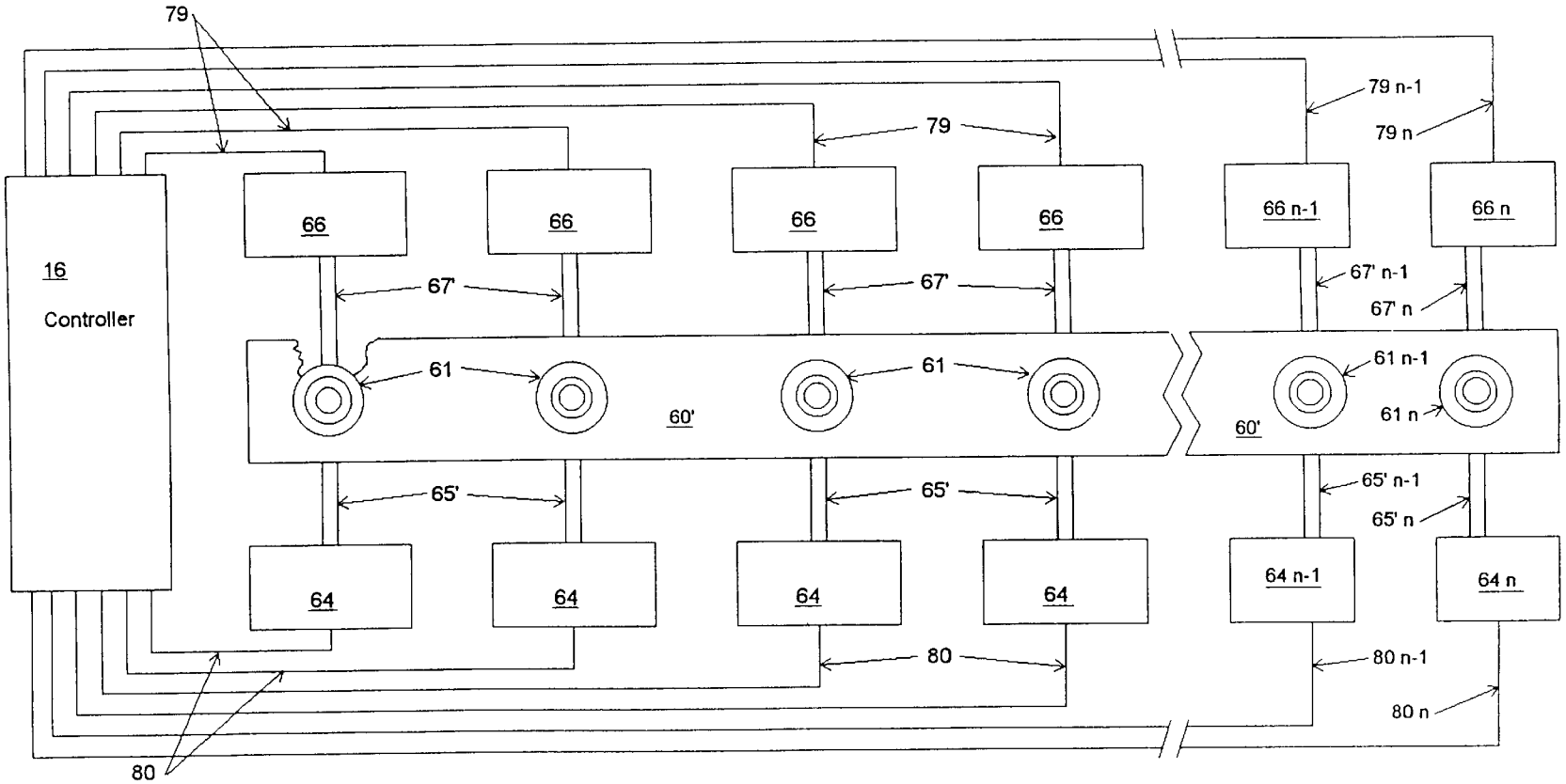
FIG. 10 is a view similar to FIG. 7 with additional coaxial nozzles to enable the application of additional colors or coatings.
Figure 11:
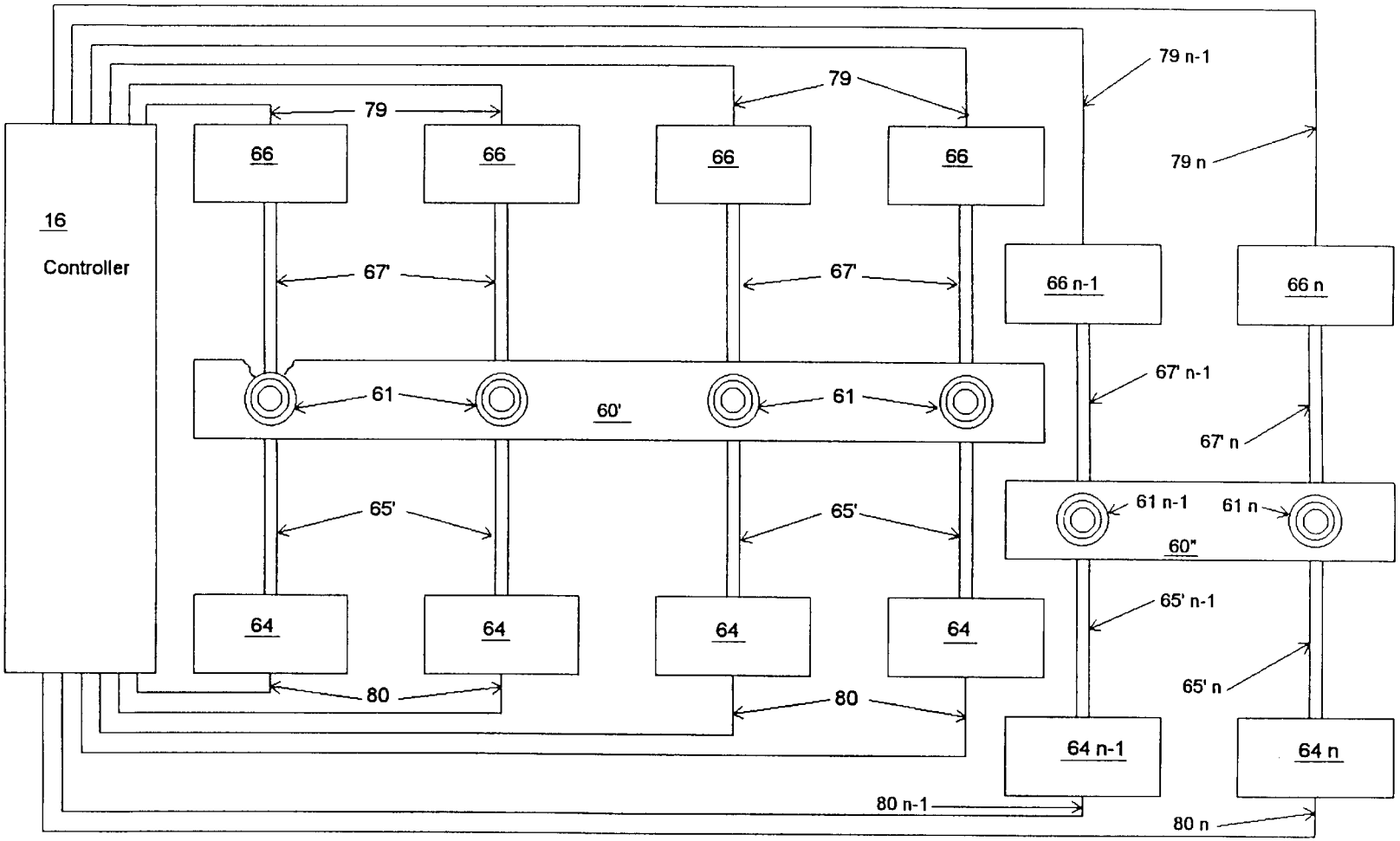
FIG. 11 is a front view of another spray head arrangement using separate nozzles for additional colors, coatings, etc.

FIG. 4 illustrates a modification of the apparatus of FIG. 3 to enable ink deposition on both sides of the recording medium or substrate, for back-lighting and/or front-lighting applications, wherein mirror images are deposited on opposite sides of the recording medium. As pointed out above, U.S. Pat. No. 5,144,328 sets forth background for back-lighting whereby substantially the same spectral content to a viewer is produced when the image is illuminated with front or back lighting. Components of FIG. 4, which are the same or similar to those of FIG. 3, are given corresponding reference numerals. The basic difference is the addition of an additional drive roller assembly and a second set of printer or spray heads whereby ink is deposited on the opposite side of the recording medium or substrate, eliminating the need to print one side, remove it from the press, turn it over, and reregister to print on the opposite side. As shown in FIG. 4, recording medium 27 is passed around drive roller 32 wherein ink is deposited on one side thereof via spray heads 48 as indicated at 27' and is dried by drying assembly 49', as in FIG. 3. The medium 27' is then passed around a second drive roller assembly 32' having a pair of support rollers 35' and 36' supported on frame 23' via support members 37', where ink is deposited on the opposite side of medium 27' by a printer assembly 21' composed of a carriage 41', which is moved along a rail 42' via a cable secured at ends 45' (see FIG. 2), with carriage 41' containing several spray heads 48' (only three being shown). As set forth above, each spray head 48' may be provided with a plurality of coaxial spray nozzles such as illustrated in FIGS. 7, 10 and 11. As seen in FIG. 4, the drive roller assembly 32' and printer assembly 21' are identical, but located in a reverse direction from drive roller assembly 32 and printer assembly 21. After passing around drive roller assembly 32' and a mirror image to that on medium 27' is deposited, the recording medium, now indicated at 27" is directed past a drying light assembly 49", an idler roller 53, an adjustable height cutter assembly 50 to a take-up roller assembly 33, which is driven by a controlled speed motor (not shown) or by driven rollers 51' as described above with respect to FIG. 3. If desired, the idler roller 53 may be omitted and the cutter assembly 50 relocated such that the medium 27" passes directly from the drive roller assembly 32' to the take-up roller assembly 33' as in FIG. 3. The mirror or unique images deposited on opposite sides of the substrate or recording medium, as indicated at 27' and 27" in FIG. 4, may be utilized for back and/or front lighting applications as discussed above. As in the FIG. 3 embodiment, the drive roller assemblies 32 and 32' may be modified to add a radially located idler roller to provide for flat surface printing on opposite sides of the recording medium. Also, tensioning arrangements as described above in the FIG. 3 embodiment may be employed in the FIG. 4 embodiment.

Figure 5:
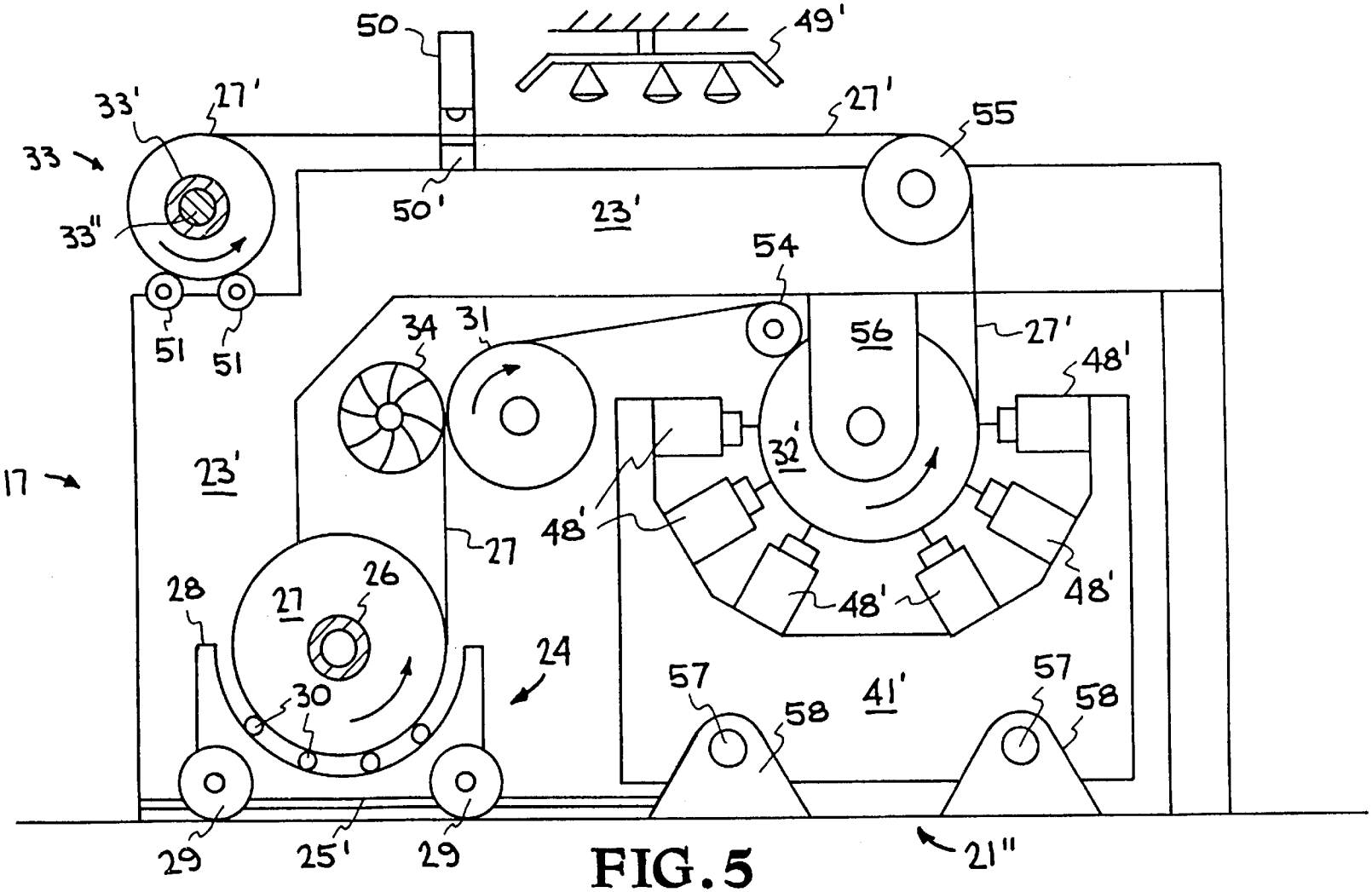
FIG. 5 schematically illustrates a side view of another embodiment of the imaging apparatus made in accordance with the present invention.

The embodiment illustrated in FIG. 5 incorporates a multiple spray head arrangement (6 shown) and includes components identical or similar to those of FIG. 3, and such are given corresponding reference numerals. As shown in FIG. 5, the recording medium or substrate carriage assembly 24 is mounted on a track 25 within frame 23', as in the FIG. 3 embodiment. Recording medium 27 from carriage assembly 24 is fed between an idler roller 31 and a smoothing brush 34, around drive roller assembly 32', and which is held against the roller assembly 32' by a roller assembly 54, which is adjacent to and contiguous with roller 32' along the entire length thereof. As the medium 27 passes around drive roller assembly 32', ink is deposited thereon by printer assembly 21" to produce an image on the recording medium now indicated at 27'. The recording medium 27' then passes via an idler roller 55, drying lamp assembly 49', and adjustable height cutter assembly 50 to take-up roller assembly 33, Drive roller or platen assembly 32' differs from drive roller assembly 32 in FIG. 3 in that it is suspended from frame 23' by members 56, only one shown, and is driven by an electric motor, not shown, as in the FIG. 3 embodiment. Only one roller assembly 54 is required in that recording medium 27 is tensioned essentially vertically to idler roller 55. Roller assembly 54 is suspended from frame 23' by spaced members similar to roller supports 37 of the FIG. 3 embodiment, and located along the length of and secured to frame 23' to maintain contiguous alignment with the drive roller assembly 32' and the recording medium 27 located thereon. Roller 54 and the supports therefore may be constructed, as described above relative to support rollers 35 and 36, to be composed of interconnecting sections with adjustable supports for the various sections.

Printer assembly 21" includes a carriage 41' on which is positioned several (six shown) printer or spray heads 48'. Note that none of the spray nozzles of spray heads 48' are positioned straight up or vertically with respect to the drive roller assembly 32', which prevents adverse ink deposition on the recording medium due to gravity in the ink tube.

Figure 9:
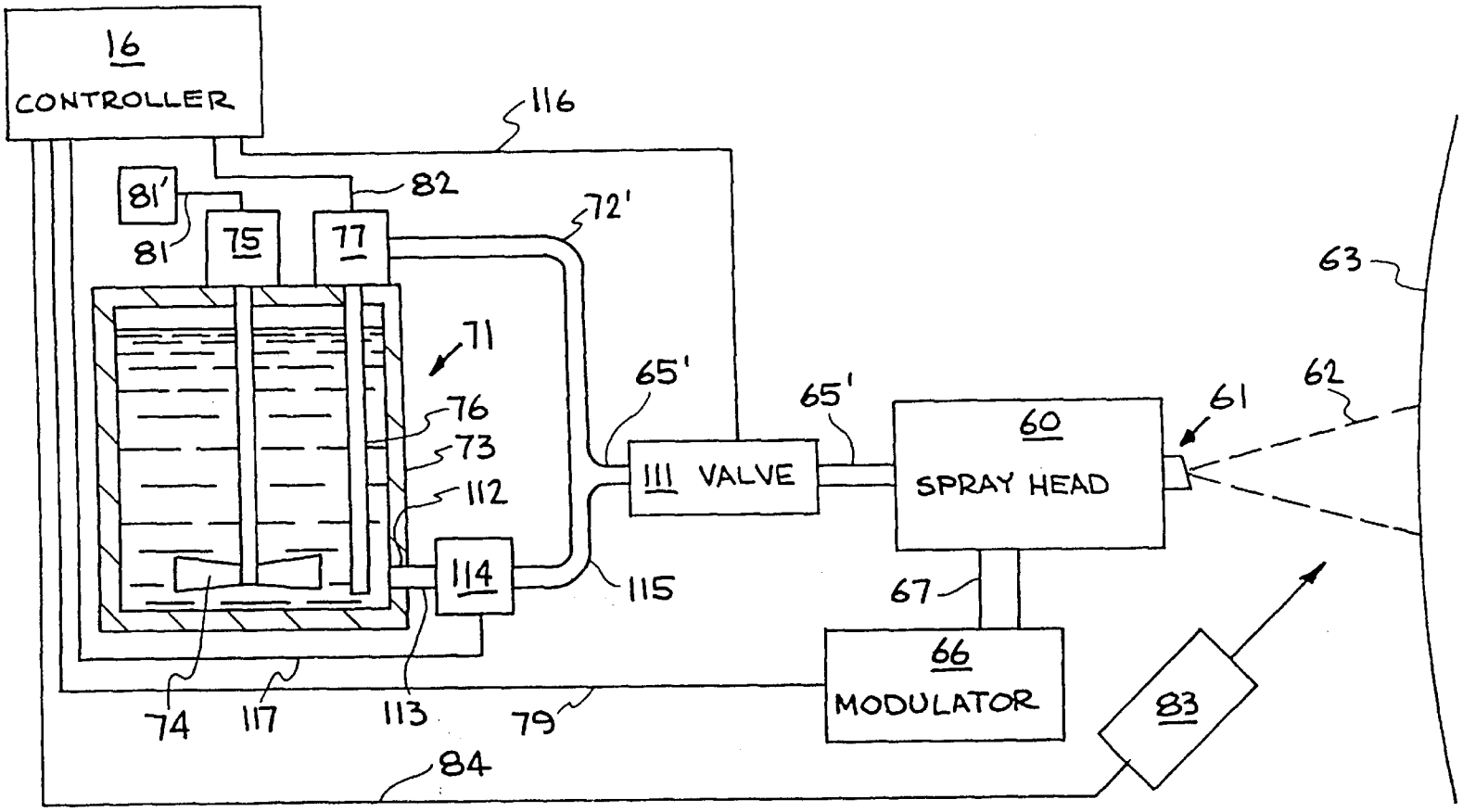
FIG. 9 illustrates in partial cross-section another embodiment of a spray head with a pressure modulated air supply system which utilizes an ink controlling device for providing injection into a continuous or pulsed flow of air through the pressure modulated air valve.

When a piezoelectric ink valve is used, as in the FIG. 9 embodiment, with a pressurized ink system and continuously (or pulsed) flowing air, then a vertical position of the spray nozzles could be tenable. Carriage 41' is mounted on annular rails or members 57 which are supported by members 58, with the rails 57 functioning as axial bearings and serving the function of the rail 42 in FIG. 3. While not shown in FIG. 5, the carriage 41' is moved along the length of rails 57 by a cable, pulley and motor arrangement, such as components 44–47 of FIGS. 2 and 3, or by other means such as a timing-belt or rack and pinion arrangement as described above. As printer assembly 21" passes along recording medium 27 an image width equal to that of the number (n) of individual spray heads used (each having a plurality of spray nozzles) is deposited on the medium, thus resulting in a finished image in 1/n of the time required for a single spray head to deposit the image. The FIG. 5 embodiment may be modified as described above with respect to FIG. 3 to provide for flat section spraying and the use of separate tension rollers.

Figure 6:
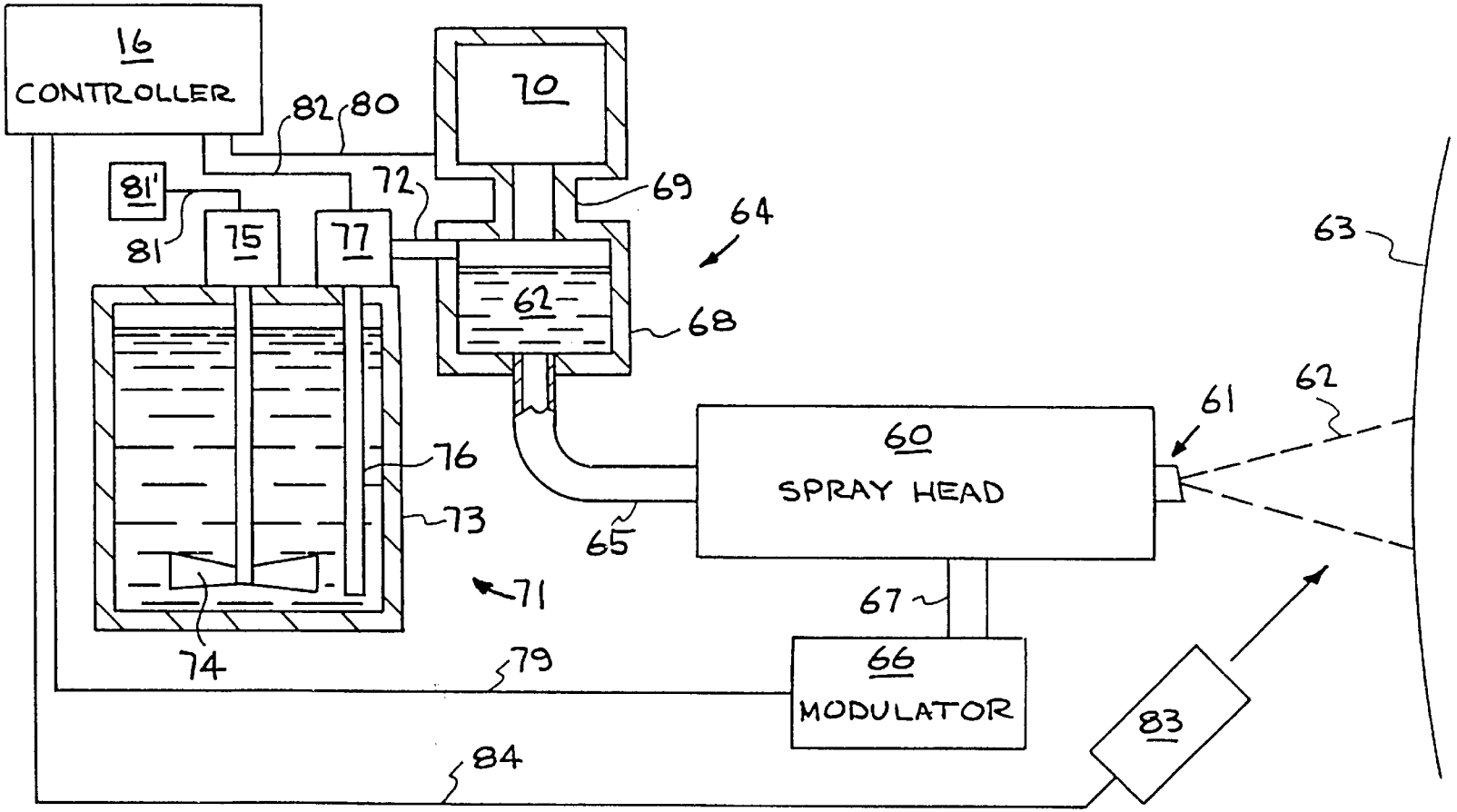
FIG. 6 is a partial cross-sectional side view of an embodiment of a spray head and ink/air supply systems in accordance with the present invention.
Figure 8:
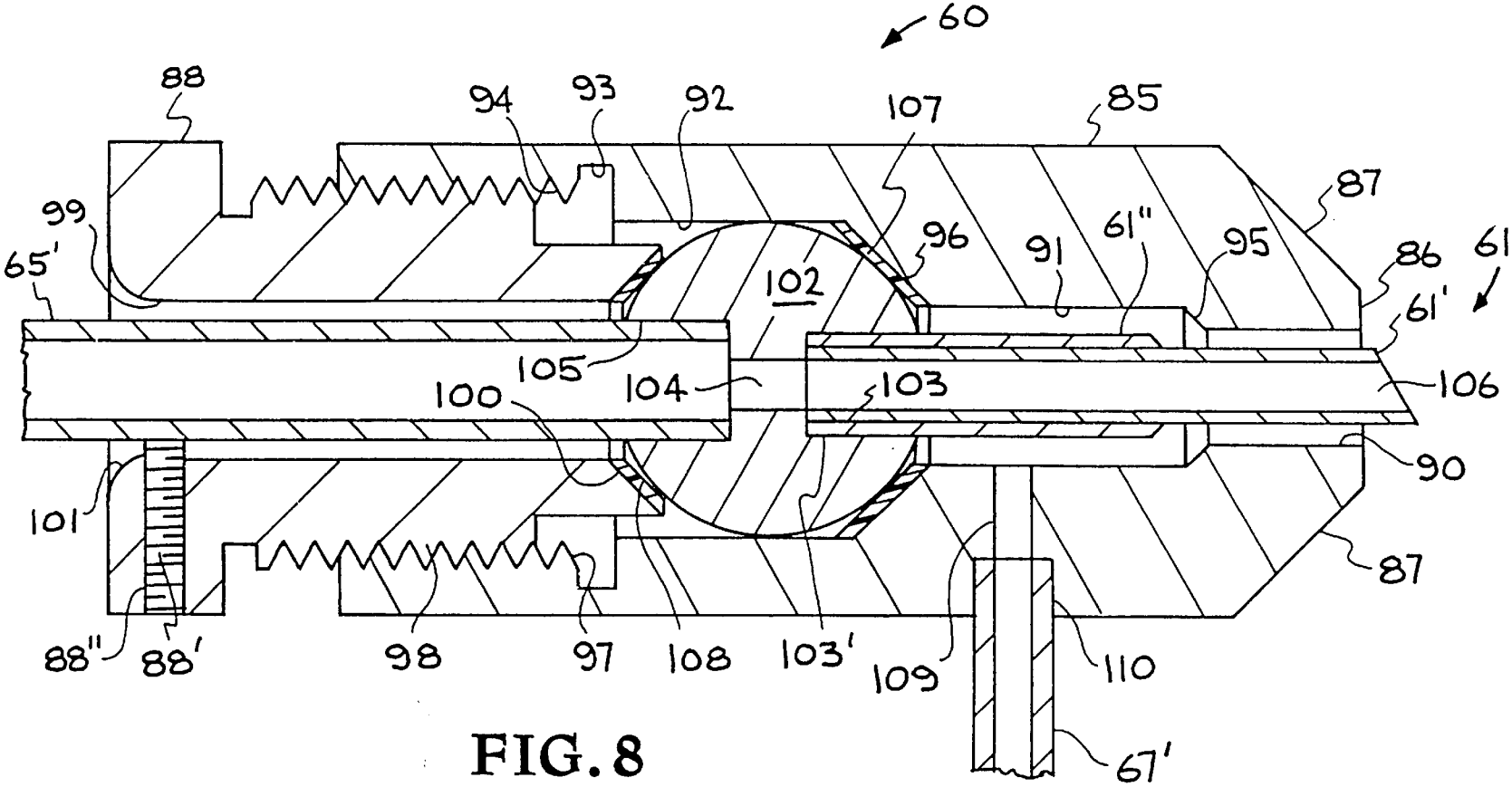
FIG. 8 illustrates a cross-section view of an embodiment of a spray head made in accordance with the present invention.

Printer assembly 21 is illustrated in greater detail in combination with controller 16 and an ink reservoir arrangement by the embodiments of FIGS. 6, 7, 9, 10 and 11, with FIG. 8 illustrating an improved concentrically adjustable spray nozzle for the printer assembly. While shown in FIGS. 6 and 9, the controller 16 and ink reservoir assemblies would be mounted on frame 23 of mechanism 17. As pointed out above, the printer assembly utilizes a coaxial ink/air spray principle, as in above-referenced U.S. Pat. No. 4,839,666, but the construction of the spray head differs dramatically from the spray head of the patent, as seen in FIG. 8, and the ink/air controls differ greatly as seen in FIG. 6 and 9.

The embodiment illustrated in FIG. 6 comprises a spray head 60 having at least one coaxial spray nozzle, generally indicated at 61, through which a gas (air) and deposition medium 62 is directed onto a recording medium or substrate 63. Deposition medium, such as ink, is supplied to spray head 60 from a reservoir, generally indicated at 64 via a line or tube 65, and a gas under pressure (such as compressed air) is supplied, from a source not shown, to the spray head 60 via a modulator or control valve assembly 66 and a line or tube 67. Details of an embodiment of the spray heal 60 are illustrated in FIG. 8.

Reservoir 64 includes an ink chamber 68 open to the atmosphere or connected via a line or tube 69 to a chamber 70 containing a gas (air) under pressure, from a source not shown, and functions as a pneumatic modulator. Chamber 70 may be provided with a pressure relief valve, if desired. A mixer and pump assembly, generally indicated at 71, is connected via a line or tube 72 to ink chamber 68. Assembly 71 includes a housing 73 containing ink and within which is positioned a mixer or steering member 74 driven by an electric motor 75 which may be mounted on the upper end of housing 73, and a tube 76 connected to a pump 77 which may be mounted on housing 73, such that mixer member 74 maintains ink in a desired consistency or composition, and pump 77 supplies ink to reservoir chamber 68 with tube 76 and tube 72 functioning as the pump intake and discharge lines. It is pointed out that the reservoir chamber 68 is small (e.g. contains about ¼–⅓ pint of ink) and thus is refilled as required.

A controller 16 is connected to direct control signals through components 19 and 20 of FIG. 1 to modulators 66 and 70 and pump 77, as indicated by leads 79, 80, and 82. An on-off switch 81' is connected to motor 75 via lead 81 so that mixer 74 may be operated manually or shut down. However, if desired, the switch 81 could be controlled via controller 16. Also, controller 16 is connected to an optical feedback sensor or readout device 83 as indicated by lead 84. Optical sensor 83 may, for example, be a conventional densitometer or an optical fiber arrangement, which generates optical feedback signals indicative of the image being deposited on the recording medium 63, which signals are utilized in controller 16 to adjust appropriate control signals to the modulators 66 and 70 to change, if needed the flow of ink and gas passing through the coaxial nozzle 61 of spray head 60. The construction and function of modulators 66 and 70 are known in the art, as exemplified by above-referenced U.S. Pat. No. 4,839,666, and thus need not be described in greater detail.

FIG. 7 illustrates a multiple coaxial spray nozzle arrangement mounted in a, single spray head, provided with ink and gas (air), and individually operated through controller 16 as in FIG. 6. Since the various components of FIG. 7 are the same or similar to components in the FIG. 6 embodiment, corresponding reference numerals are provided. As seen in FIG. 7, a spray head 60' is provided with four (4) spaced coaxial spray nozzles 61 to each of which is supplied ink from a reservoir 64 via tube 65' and gas (air) via a, modulator or control-valve 66 via tube 67', and regulated by controller 16 as indicated by leads 80 and 79, respectively. Each reservoir 64 contains an ink of a base color which when over sprayed produces the desired color. Where the coaxial spray nozzles 61 are mounted in a row, the spacing therebetween must be such as to prevent undesired overlap or insufficient overlap so as to produce a smoothly blended portion of the image on each pass across the recording medium.

FIG. 8 illustrates an enlarged cross-section of an embodiment of the spray head 60 and coaxial nozzle 61 of FIG. 6. The spray head 60 comprises a body member or housing 85 having a front end thereof composed of a flat face section 86 and a tapered section 87, and an opposite end thereof adapted to receive a threaded nut or retainer member 88. The tapered front end 87 allows for closer positioning of multiple spray heads, but may be omitted. Body member 85 is provided with an axially extending central passage or opening therethrough of different diameter sections 90, 91, 92, 93 and 94, with sections 90 and 91 interconnected by a tapered or contoured section 95 and sections 91 and 92 interconnected by a tapered or contoured section 96, and with section 94 being threaded at 97 to receive threads 98 of nut 88. Nut 88 is provided with a central opening or passage 99 having a tapered inner end 100 and a tapered or flared outer end 101. As seen hereinafter, the section 90 of the axially extending passage in body member 85 constitutes an air jet section of the coaxial spray nozzle.

A ball-like or spherical alignment member 102 is positioned within central opening section 92 of body member 85 anti retained between tapered section 96 of the body member and tapered end 100 of central opening 99 in nut 88. Spherical member 102 is provided with a central opening composed of sections 103, 104 and 105. An ink inlet or supply tube 65' extends through opening 99 in nut 88 and terminates in the opening section 105 of spherical member 102. An ink outlet tube 61' extends through body member opening sections 90 and 91 and terminates in the opening section 103 of spherical member 102. Ink tube 61' is preferably tapered at the outer end 106, with the taper being 30 , for example, for reasons set forth hereinafter, but the end of tube 61' may be perpendicular or flat, depending on the air passage and pressure. Opening section 103 of spherial member 102 includes an enlarged outer section 103' into which is secured an end of a support tube 61". Tube 61' can be enlarged or shortened and integrated with tube 61" to provide the necessary support for the tube 61', due to its very small diameter, and provide proper air passage size and shape. A thin (0.002 to 0.003 inch) member, washer or seal 107 made, for example, of nylon or Teflon, is located adjacent the tapered section 96 of the central opening in body member 85 to prevent air leakage, and a washer or thin member 108 of Teflon, for example, is located adjacent the tapered end 100 of the central opening 99 in nut 88 to reduce friction between nut 88 and spherical member 102. The composition of the various components will be dependent on the type of deposition medium being used. For example, components 85, 88, 61' and 102 may be constructed of stainless steel, brass, or a combination, when used with ink. Other materials may be used which do not react with the type of deposition medium or ink being used. Body member 85 is additionally provided with a radially extending opening 109 which is in communication with opening section 91 thereof and having an enlarged outer section 100 in which air supply tube 67' terminates. The air supply tube 67' may be flush sealed in opening 109 by an O-ring, thus eliminating the enlarged outer section 110 of the opening 109.

To eliminate flexing or movement of tube 65' within opening 99 of nut 88 a plurality (3 for example) of set screws 88', or the like, are located in threaded openings 88" of nut 88 (only one set screw 88' being shown).

The purpose of the spherical member 102 is to locate or position and maintain ink tube 61' in a coaxial position within central opening section 90 of body member 85, which functions as the air jet and together with ink tube 61' form the coaxial spray nozzle 61 of FIGS. 6 and 7. Concentric relationship between the ink tube 61' and passage section 90 of the body member 85 is essential to provide an even distribution of ink from coaxial nozzle 61 by the air flowing therearound and through opening section 90 of body member 85. The end 106 of tube 61' extends from end 86 of housing or body member 85 and is tapered to assure an even flow of air past the ink at the end of the tube and assist in precise ink extractions. The amount of taper on tube end 106, and the distance the tube 61' extends from body member 85, is determined by various parameters including, for example, the pressure of ink and/or air, and ink viscosity. By way of example, the nozzle 61' has an internal diameter of 0.006 to 0.014 inch and an external diameter of 0.010 to 0.025 inch, with the axial opening section 90 of body 85 having a diameter of 0.020 to 0.035 inch. These diameters are dots per inch (dpi) and speed dependent and thus will vary, possibly beyond the diameters indicated, depending on the type of deposition medium, for example, being used.

The construction and design of the spray head 60, as illustrated in FIG. 8, renders it easy to clean and reassemble, and to assure concentricity of the coaxial nozzle 61, thereby eliminating problems associated with the ink/air distribution as well as reducing the down time for cleaning of the spray head 60. Operational cleaning of the spray head 60 is described hereinafter.

The spherical member 102 of FIG. 8 may be modified to enlarge passage or opening section 104 to the size of opening section 103, whereby the tube 61' can be inserted into or secured to tube 65', thereby minimizing the need to use tube 61" for support and the enlarged end 103' of opening 103. Also the tube 65' and tube 61' can be formed integral with a reduced diameter section thereof constituting the ink tube 61', with the opening through spherical member 102 being configured to accommodate the integral formed tubes 65' and 61'. In addition, support tube 61" can be formed integral with spherical member 102. The air seal 107 can be replaced by an O-ring type seal located in an annular groove around the spherical member 102, so as to cooperate with the surface of axial passage section 92 of body member 85.

Downtime and associated costs also result from cleaning the ink tubes of the coaxial spray nozzles, particularly. Cleaning of at least the ink tubes 65' and 61' of FIG. 8, for example, is required at the end of the work period or if the press is to be idle for a period of time. Previously, this required the spray head to be removed from the press, cleaned, then reassembled on the press before use. A system to preclude this comprises a reservoir containing a suitable solvent mounted on the press mechanism 17 and connected via tubes and valving to each of the ink supply tubes of the spray heads being used. For example, in the FIG. 7 embodiment, a multiple spool or slide valve arrangement is mounted adjacent the spray head 60' and connected to the ink tubes 65' and to cleaning solvent, tubes, whereby activation of the spool valve would shut off the ink supply from ink reservoirs 64 to tubes 65' and connect the tubes 65' to the solvent reservoir, and with the coaxial nozzles 61 directed into a catch basin, the cleaning solvent is passed through the spray head 60 until the nozzles 61 are clean. The spool valve can be activated electrically, pneumatically, mechanically, or manually, and the solvent may be pressurized as needed. Other types of valves may be utilized, depending on the specific spray head arrangement and the cleaning required. The above cleaning system can readily be modified such that all or any one of the nozzles in the spray head 60' can be cleaned, whereby a different color may be used in that single cleaned nozzle.

FIG. 9 illustrates another embodiment of the spray head ink/air flow control arrangement, while utilizing a conventional spray head or the spray head of FIG. 8. In this embodiment, as in the FIG. 6 embodiment, there is a continuous flow of ink which may or may not be under pressure. Such continuous flow could also be used in the arrangement of FIG. 6. This embodiment utilizes a piezoelectric valve arrangement opening to let ink under pressure flow into an air stream that may be pulsed or continuously flowing. The piezoelectric valve arrangement could also be used with a non-pressurized system of the type illustrated in FIG. 6 by using an undulating piezoelectric valve. This type of valve would undulate to isolate, control volume, and create pressure to force (squirt) ink into a continuous or pulsed flow air stream. Since certain of components in FIG. 9 are the same or similar to components in FIG. 6, corresponding reference numerals are set forth, and only the new components are described. A piezoelectric valve assembly 111 is positioned in ink inlet line 65' which directs ink into spray head 60. An ink supply or outlet line 72' from pump 77 is connected to line 65' prior to the inlet of valve assembly 111. Housing 73 is provided with an opening 112 in the lower end thereof and provides fluid connection via a tube or line 113 between the interior of housing 73 and a pressure modulated valve 114, with valve 114 being connected by a tube or line 115 to lines 65' and 72'. If desired a tube, such as 113, may extend from a lower end of housing 73 through an opening in the top of the housing and into valve 114, thus eliminating opening 112. Thus, a pressurized or unpressurized flow or a continuous flow or modulated flow of ink can be supplied to the inlet line or tube 65' of piezoelectric valve assembly 111 via components 76, 77 an 72' and/or components 113–115, via control signals from controller 16. Controller 16 is operatively connected to provide control signals to piezoelectric valve assembly 111 as indicated by lead 116, and to pressure modulation valve 114, as indicated by lead 117, as well as to pump 77 via lead 82. As in FIG. 6, an on-off switch 81' is connected to motor 75 via lead 81 for independent operation of the mixer or stirring mechanism 74, or may be connected to controller 16. Piezoelectric valves and pressure modulated valves are well known off-the-shelf components and thus a further description of their construction and function is deemed unnecessary. As in the FIG. 6 embodiment, an optical feed back mechanism 83 is connected by lead 84 to controller 16.

While the embodiment of FIG. 9 has been described using a piezoelectric valve arrangement, other ink flow controlling devices for providing injection into either a continuous or pulsed flow of air may be utilized, such that the deposition medium can be supplied either under pressure or without pressurization. By way of example, other ink flow controlling devices include micro-pumps, solenoid valves, etc.

FIG. 10 is a modification of FIG. 7 in which the spray head is provided with additional spray nozzles (greater than four) to enable the application of greater than the standard four colors during normal processing, or add or incorporate a coating medium, whereby special colors, graffiti coatings, or special effect paints can be applied as the spray head(s) pass along the recording medium. The additional spray nozzle or nozzles may be of a coaxial or other type, although coaxial is preferred. Components similar to those in FIG. 7 are given corresponding reference numerals.

FIG. 10 illustrates a multiple coaxial spray nozzle arrangement mounted in a single spray head, provided with ink and gas (air), and individually operated through controller 16, as in FIG. 7, but with additional spray nozzles (greater than four), six being shown in FIG. 10, for application of additional colors or coatings, which can be applied to the recording medium as the spray head passes therealong, or applied separately from the standard four color processing. As seen in FIG. 10, a spray head 60' is provided with at least six (6) axially aligned, spaced coaxial spray nozzles, with four nozzles (as in FIG. 7) being indicated at 61 and the additional two nozzles being indicated at 61n−1 and 61n respectively since any number (n) of nozzles greater than four can be utilized, depending on the need for additional colors or coatings. Thus the spray head 60' of FIG. 10 may include 5 to n nozzles. Each of the nozzles is supplied ink, or other deposition medium, from individual reservoirs, indicated at 64, 64n−1 and 64n, via a tube, indicated at 65', 65n−1 and 65n, and gas (air) via individual modulators or control-valves, indicated at 66, 66n−1 and 66n, via tubes, indicated at 67', 67n−1 and 67n, each regulated by controller 16 as indicated by leads 80, 80n−1 and 80n, and 79, 79n−1 and 79n, respectively. Each of reservoirs 64 contains an ink of one of the four base or normal processing colors, which when oversprayed produces the desired color, while reservoirs 64n−1 and 64n contains a special color or coating medium which when deposited singly or when oversprayed or intersprayed with one or more of the base colors produces the desired logo color, graffiti coating, metallic, black-light, day-glo or other special effects paint, etc. Where the spray nozzles are mounted in a row (axially aligned), as in FIG. 10, the spacing therebetween must be such as to prevent undesired overlap or insufficient overlap so as to produce a smoothly blended portion of the image on each pass across the recording medium. The nozzle cleaning arrangement described above with respect to the FIG. 7 embodiment can be utilized in the FIG. 10 arrangement.

FIG. 11 differs from FIG. 10 by utilizing separate spray heads containing one or more nozzles or ports, either coaxial or other type, for applying colors or coatings, in addition to the base four color processing as in FIG. 7. The additional nozzles or ports may or may not be operated the same way as the current operational modes as in FIG. 10. Components in FIG. 11, which are similar to components of either FIG. 7 or FIG. 10, are provided with similar reference numerals. While the FIG. 11 embodiment includes the four nozzles for the standard four color processing, the additional nozzles may be of different port size for air and deposition medium, and thus controlled by computer software or electronic boards different from those used to operate the currently used four colors. Also, such separate nozzles could be utilized for mirror imaging in back lighting techniques wherein it is beneficial or desired to utilize special colors or special effect paints, for example, as well as protective or graffiti coatings. The cleaning system described above relative to FIG. 7 can be used to clean this embodiment. The FIG. 11 embodiment illustrates a multiple coaxial spray nozzle arrangement (four in number) mounted in a single spray head 60' provided with ink and gas (air), and individually operated through controller 16, as in FIG. 7, but with additional (one-nth) spray heads, nozzles, or ports located separate from the multiple nozzles 61 of the single spray head 60'. These additional nozzles or ports (two shown) are positioned in a separate spray head indicated at 60", with the nozzles being indicated at 61n−1' and 61n', although any number of such additional nozzles can be used. Also, the spray head 60" can be located in any designed position with respect to spray head 60'. The reservoirs and modulators or control-valves and the connecting lines are shown connected to control 16 in this embodiment. However, as pointed out above, they may be controlled by other means, which would provide the overspray of the desired additional colors or deposition medium beyond the standard four colors.

Thus, in each of the embodiments of FIG. 10 and 11, the principle of the present invention has been illustrated; namely, the addition of one or more spray nozzles to enable the use of more than the standard four colors. While each of FIGS. 10 and 11 has illustrated two additional nozzles, that number may be from 1 to n, depending on the number of different colors or type of deposition medium desired. By the use of the additional nozzles (FIG. 10) or the additional spray head (FIG. 11), the capability to produce a great variety of color tones, logos, etc. is now available, thus significantly advancing the state of the art.

The above-referenced U.S. Pat. No. 5,144,328 discusses the use of translucent/transparent substrates, etc. covering aspects of producing color graphic art for backlighting use. One backlighting approach which has been known and used for some time is double coating one side of a translucent substrate and using the back lights 100% of the time to preclude the darkening effect of just utilizing front lighting. This provides the same visual impression to a viewer whether it is daytime or nighttime.

A new approach involves putting a color image on one side of a translucent substrate as is now done for normal front lighting and then coat or attach a film on the opposite side with a material which will absorb or reflect the percentage of light equivalent to that absorbed by one coating of the image, and would not be a mirror image color coat. This coating or attached film would absorb/reflect wavelengths over the visible spectrum. Such a coating or film can be made using micro layers or dispersed flakes of material to respond to the three prime colors used and adjust the coating or film density/thickness to absorb the proper light percentage. Such a coating or film could be a single one covering the complete color spectrum. The coating can be carried out using the above-described FIG. 4 apparatus or be pre-applied by the substrate manufacturer.

Another new approach involves producing an image on the opposite side of a translucent substrate with the coating composed of a transparent material carrying enough of the specific reflective flakes or material of that particular prime color spectural wavelength to absorb/reflect the desired amount of back light. There would be three mixtures corresponding to the wavelength of each prime color used and be spray intermixed by the printer in similar proportions as a pigmented coat but be transparent with no matching color. Also, the opposite side can be coated with pigmented colors of a different but complimentary image.

Either of the two above-described new approaches would provide essentially the same visual impression to the viewer during the daytime with the back lights off or at nighttime with the back lights on.

It has thus been shown that the present invention has provided an imaging apparatus having the capability to use more than the standard four colors and which reduces the time and associated costs of producing large graphic reproductions, while eliminating platen deflection and substrate tracking problems, reducing the down time between image reproductions, to provide an improved spray head which assures accurate coaxial ink/air flow while being easily cleanable, as well as to provide new approaches for backlighting applications. Thus, this invention provides a significant advance in the field of graphic reproductions, particularly large reproductions such as used for outdoor advertising, using front and/or back lighting capabilities.

While the invention has been described and illustrated using coaxial nozzles, the multi-color (greater than four) capability can be utilized with any type of nozzles or spray heads capable of control which enables the overspray of colors in excess of the standard four processing colors, or enables the use of other types of spray coating, such as may be needed for graffiti protection, clear coats, etc. By the use of the five or greater spray nozzles, the capability to produce images, both large and small, in a variety of colors is provided.

While particular embodiments of the image forming apparatus, an embodiment of an improved spray head, spray heads using more than four color nozzles, and new approaches for backlighting have been illustrated and/or described to explain the principles and function of the invention, such is not intended to limit the invention. Other embodiments, processes, and different materials, parameters, etc., as well as modifications and changes will become apparent to those skilled in the art, and it is intended that the invention be limited only by the scope of the appended claims.

What is claimed is:

1. In a system for reproducing an image including means for generating control signals to a spray head and to at least one mechanism for moving a recording medium, the improvement including:

at least one spray head movably mounted to pass along a recording medium for directing deposition medium onto at least one side of the recording medium and including a deposition medium and air nozzle arrangement, said nozzle arrangement including nozzles greater than four in number for depositing deposition medium having colors greater than four, and being provided with at least air flow control means.

2. In the system of claim 1, the improvement additionally including means for preventing deflection of the recording medium along the width thereof of which at least one spray head passes, said means including at least one roller assembly, said roller assembly having a length of at least the length of the recording medium.

3. In the system of claim 1, the improvement additionally including means for directing deposition medium on opposite sides of the recording medium, said means including means for changing direction of movement of the recording medium, and at least one additional spray head having a capability to deposit colors greater than four in number, for directing deposition medium on an opposite side of the recording medium.

4. In the system of claim 1, the improvement additionally including movable means for supplying recording medium, said movable means including a carriage for retaining the recording medium therein.

5. In the system of claim 1 wherein said mechanism for moving said recording medium includes a drive roller assembly and a take-up roller assembly, and wherein said improvement includes means for smoothing said recording medium prior to it passing around said drive roller assembly.

6. The improvement of claim 5, additionally including at least one roller assembly positioned adjacent to and extending along substantially the length of said drive roller assembly for preventing deflection of the drive roller assembly and the recording medium.

7. The improvement of claim 6, wherein said at least one roller assembly includes a roller composed of a plurality of interconnected sections and a plurality of adjustable support mechanisms for said interconnected sections of said roller.

8. The improvement of claim 6, additionally including a second roller assembly positioned in spaced location with respect to said at least one roller assembly and having a length equal to said one roller assembly.

9. The improvement of claim 6, additionally including drying means located intermediate said drive roller assembly and said take-up roller assembly.

10. The improvement of claim 6, additionally including means located adjacent to said take-up roller assembly for cutting the recording medium.

11. The improvement of claim 5, additionally including means for changing the direction of movement of said recording medium after it passes said drive roller assembly, and at least one additional spray head for directing deposition medium onto an opposite side of said recording medium.

12. The improvement of claim 11, wherein said at least one additional spray head directs deposition medium onto said opposite side of said recording medium so as to be in mirror image of that deposited on said at least one side of said recording medium.

13. The improvement of claim 12, wherein a plurality of spray heads are located to direct deposition medium onto each side of said recording medium to reduce the number of passes across the recording medium for producing a desired image.

14. The improvement of claim 5, additionally including a plurality of spray heads, at least one of which includes at least one additional nozzle to enable depositing more than the basic four processing colors, said sprayheads being positioned in spaced relation for directing deposition medium onto said recording medium from each of said plurality of spray heads.

15. The improvement of claim 5, wherein said take-up roller assembly includes a plurality of driven rollers which support, and rotate a roll of recording medium.

16. The improvement of claim 1, wherein said at least one spray head includes coaxial nozzles of a number greater than four, each nozzle is composed of:

a body member having an axial opening and a radial opening therein, and a movable member located in said axial opening of said body member, said movable member including means for providing and maintaining concentricity of members defining said coaxial nozzle, means for securing said movable member in said body member, said movable member being provided with tube means for passage of deposition medium therethrough, said tube means including a nozzle having a tapered or flat outer end and coaxially located within said axial opening in said body member, said movable member being constructed and positioned in said body member to establish and maintain said nozzle in concentricity with said axial opening in said body member, said radial opening adapted to be connected to a gas supply for directing gas around said nozzle for directing and dispersing deposition medium passing through said nozzle onto said recording medium.

17. The improvement of claim 16, additionally including means for controlling flow of deposition medium and gas through said body member.

18. A method for producing reproductions, utilizing more than the basic four colors, comprising:

providing a quantity of recording medium, directing the recording medium at least partially around an idler roller and partially around a drive roller, smoothing the recording medium as it passes over the idler roller, providing at least one roller adjacent the drive roller and passing the recording medium between the at least one roller and the drive roller for preventing deflection of the drive roller and differential movement between the drive roller and the recording medium, applying a deposition medium onto one side of the recording medium, utilizing at least one spray head capable of applying greater than four colors, to produce a desired reproduction thereon, as it moves past the drive roller, drying the deposition medium after the recording medium passes from the drive roller, and directing the recording medium onto a take-up roller.

19. The method of claim 18, wherein applying the deposition medium onto the recording medium is carried out using a plurality of spray heads, providing each spray head with at least five coaxial spray nozzles, and establishing and maintaining the concentricity of each of the coaxial spray nozzles by utilizing a removable member secured in each spray nozzle and attached to a component of the spray nozzle.

20. The method of claim 18, wherein prior to directing the recording medium onto the take-up roller, the direction of movement of the recording medium is changed, and additionally applying a deposition medium to an opposite side of the recording medium.

21. The method of claim 18, additionally including supplying the deposition medium to at least one spray head and controllably releasing the deposition medium into an air stream for deposition of the medium on the recording medium.

22. The method of claim 21, additionally including providing means for controlling the air stream.

23. The method of claim 20, wherein applying the deposition medium to an opposite side of the recording medium is carried out by forming a continuous coating using a deposition medium which will absorb or reflect a percentage of light equivalent to that absorbed by one coating of an image on the recording medium, and would not be a mirror image color coat, forming the deposition medium so as to absorb/reflect wavelengths over the visible spectrum by using micro layers or dispersed flakes of material which respond to three prime colors, and adjusting the density/thickness of the coating to absorb the proper light percentage.

24. The method of claim 20, wherein the recording medium is translucent, and wherein the deposition medium is applied to the opposite side of the recording medium by depositing a coating in substantial registration with the image formed on the one side of the recording medium, and forming the coating of a transparent material carrying a quantity of specific reflective flakes or material of a particular prime color spectural wavelength to absorb/reflect a desired amount of back light.

25. The method of claim 20, wherein the deposition medium applied to the opposite side of the recording medium is produced by matching the mixture of deposition medium to correspond to the color of the image on the one side of the recording medium.

26. The method of claim 18, wherein applying the deposition medium onto the recording medium is carried out using at least one spray head having at least five nozzles; and additionally cleaning the nozzles of the spray head by:

providing means for stopping flow of a deposition medium to one or more of the nozzles of the spray head and for directing a cleaning solvent through the one or more nozzles of the spray head, directing the output from the one or more nozzles of the spray head into a container, and activating said means whereby the cleaning solvent is passed through the one or more nozzles of the spray head into the container thereby removing any deposition medium therein.

27. The method of claim 18 additionally including bonding to the opposite side of the recording medium a transparent/translucent film containing material to absorb/reflect the three prime colors spectural wavelengths, and providing the material in a sufficient thickness to match one color coat.

28. The method of claim 18, wherein the deposition medium is applied to a transparent/translucent film, and the film is bonded to the opposite side of the recording medium.

29. The method of claim 18, additionally including establishing and maintaining tension on the recording medium as it moves past the drive roller and onto the take-up roller, and allowing the take-up roller to be removed without losing the tension over the drive roller.

30. In the system of claim 1, wherein a number of spray heads greater than two are movably mounted to pass along the recording medium for directing deposition medium onto the recording medium, each of said spray heads including means capable of depositing more than four colors of deposition medium.

31. In the system of claim 1, wherein said mechanism includes a take-up roller assembly which includes means for establishing and maintaining tension on said recording medium, and which allows the take-up roller to be removed with the recorded medium without losing the recording medium tension over a drive roller assembly of said mechanism.

* * * * *